United States Patent [19]

Shoh

[11] 3,945,618

[45] Mar. 23, 1976

[54] SONIC APPARATUS

[75] Inventor: Andrew Shoh, Ridgefield, Conn.

[73] Assignee: Branson Ultrasonics Corporation, New Canaan, Conn.

[22] Filed: Aug. 1, 1974

[21] Appl. No.: 493,913

[52] U.S. Cl. ..... 259/114; 259/DIG. 44

[51] Int. Cl.[2] ..... B01F 11/02

[58] Field of Search ..... 259/4, 19, 37, 61, 99, 259/114, DIG. 44

[56] References Cited

UNITED STATES PATENTS

| | | | |
|---|---|---|---|
| 2,583,645 | 1/1952 | Hannen | 259/114 |
| 2,961,302 | 11/1960 | Sanz | 259/114 UX |
| 3,245,892 | 4/1966 | Jones | 259/DIG. 44 X |
| 3,698,408 | 10/1972 | Jacke | 259/DIG. 44 X |
| 3,780,992 | 12/1973 | Nishi | 259/19 |

*Primary Examiner*—Stanley N. Gilreath
*Assistant Examiner*—Alan Cantor
*Attorney, Agent, or Firm*—Erwin B. Steinberg; Philip J. Feig

[57] ABSTRACT

This invention refers to an arrangement for providing vibratory energy to a liquid contained in an enclosure. The liquid is readily agitated and brought to cavitation by introducing sonic energy into a strip of metal in such a manner that the strip, being immersed in the liquid, exhibits flexural vibrations and thereby agitates the liquid.

16 Claims, 10 Drawing Figures

FIG. 5
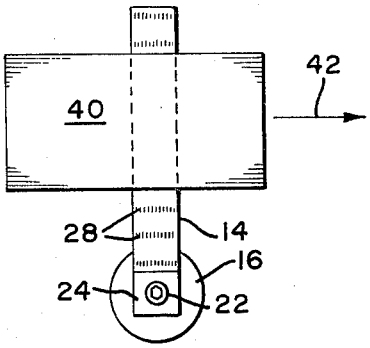
FIG. 6
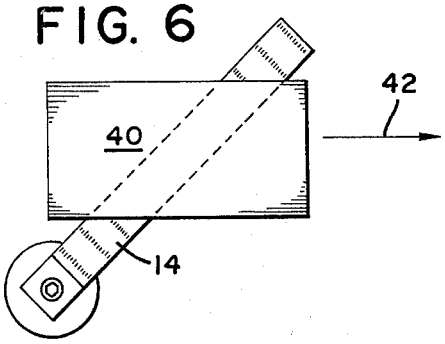
FIG. 7
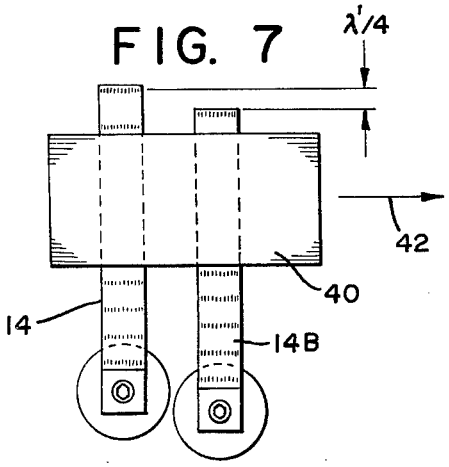
FIG. 8
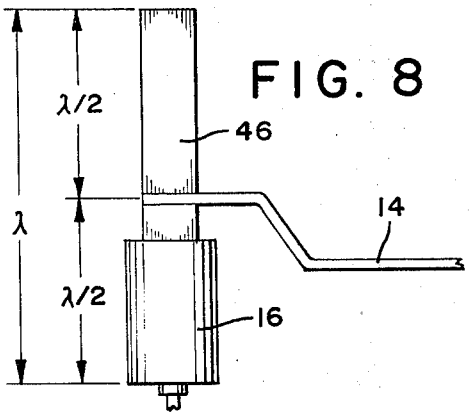
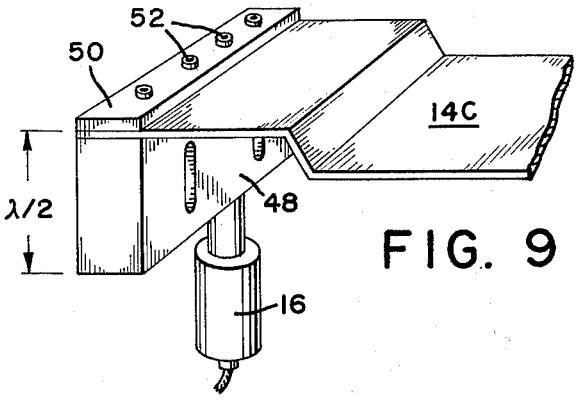
FIG. 9
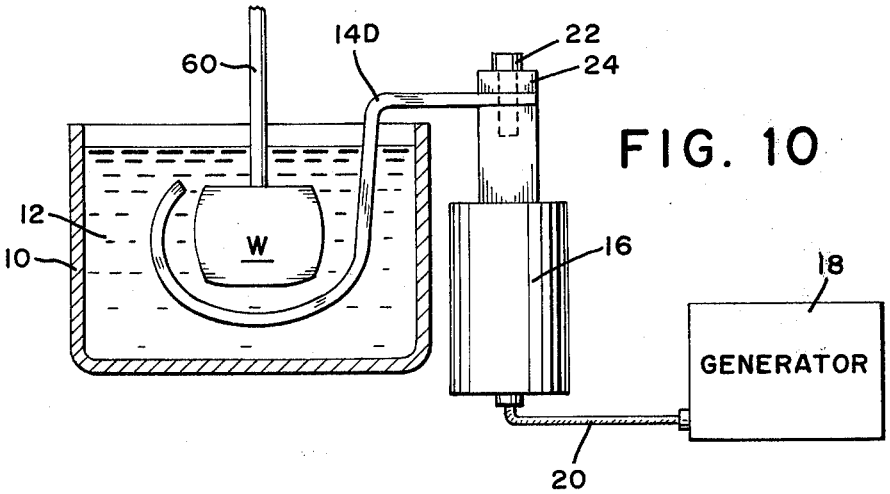
FIG. 10

SONIC APPARATUS

Background of the Invention

This invention refers to an arrangement for providing vibratory energy to a liquid and, more specifically, has reference to an apparatus in which a liquid contained in an enclosure is subjected to sonic wave energy, particularly energy in the high frequency range from 1 to 100 kHz.

The use of sonic energy for agitating a liquid in connection with cleaning, degreasing, soldering, etc. of workpieces is well-known in the art. In sonic cleaning an enclosure adapted to contain a suitable solvent is fitted with one or more transducers for transmitting energy through a selected side wall or the bottom of the tank into the liquid for causing the liquid to cavitate. The combined action of the solvent and the cavitation produced in the solvent causes a workpiece immersed in the liquid to be cleaned, that is, surface contaminants are removed in a most thorough manner, even from normally inaccessible locations. Alternatively, instead of attaching sonic energy transducers to an exterior surface of the container, a liquid submersible transducer assembly may be used. This latter arrangement comprises a liquid immersible enclosure housing therein one or more sonic energy transducers. The arrangements indicated hereinabove are well-known to those skilled in the art and are described in greater detail in "Ultrasonics in Industry", by E. B. Steinberg, "Proceedings of the IEEE", Vol. 53, No. 10, October, 1965, page 1298, or in "Ultrasonic Engineering" (book) by Julian R. Federick, John Wiley & Sons, Inc. (1965) New York, N. Y., pp. 130–145.

Aside from sonic cleaning, there is another important application in which a liquid is subjected to sonic energy, namely ultrasonic soldering or tinning. Again, transducers are attached to a tank containing molten solder and parts to be soldered or coated with metal in a fluxless manner are brought into contact with the molten metal. This application is particularly useful for soldering components to printed electronic circuit boards, for providing structural joints between aluminum wire or aluminum tubings, and the like, see Steinberg supra, page 1301.

As described in connection with sonic energy cleaning, a relatively expensive electroacoustic energy transducer, having magnetostrictive or piezoelectric transducing means, is mechanically coupled to the tank containing the liquid, such attachment being made by welding or epoxy resin in order to obtain a sound, low loss acoustic interface. In the event of a mechanical or electrical failure of a transducer means, repair or replacement of the transducer means entails certain complications and expenses. Moreover, it is known that the tank wall through which sonic energy is transmitted is subject to erosion due to surface cavitation and, hence, the tank life is limited.

Other arrangements are known, especially in connection with solder pots, in which a high power sonic converter unit is provided with a horn, also known as tool, mechanical amplitude transformer, or resonator. The frontal part of the horn is immersed in the molten metal to transmit vibratory energy to the liquid metal. Provisions must be made to maintain the converter suitably cooled. Moreover, the horn, an acoustically tuned precision part, is subject to erosion and its replacement is relatively expensive.

Brief Summary of the Invention

The present invention concerns an extremely easy and simple arrangement for introducing vibratory energy into a liquid, obviating many, if not all, of the complications and problems experienced heretofore. Quite specifically, it has been discovered that a liquid can readily be agitated and brought to cavitation by introducing sonic energy into a strip of metal in such a manner that the strip, being immersed in the liquid, exhibits flexural vibrations and thereby agitates the liquid. Flexural vibrations are known in the art, see for instance, "Ultrasonic Engineering" (book) by J. R. Frederick, John Wiley & Sons, New York, N. Y., pages 12 through 16 and "Sonics" (book) by T. F. Hueter and R. H. Bolt, John Wiley & Sons, New York, N. Y., pages 27 and 28. This arrangement is extremely simple, inexpensive, and lends itself to innumerable variations to provide an extremely versatile tool which can be suited to almost all conceivable workpiece configurations. For instance, the strip operating as a wave guide for sonic energy can be bent to conform to the general shape of a workpiece and thereby expose irregular contours of a workpiece to the intense vibrations of sonic or ultrasonic energy. The exchange or replacement of a wave guide and its attachment to the converter unit is extremely simple and is accomplished without the permanent securement features required heretofore. Since high intensity sonic energy is exhibited by the wave guide near its surface, usually within one half wavelength of the flexual standing wave in the guide, the present arrangement is particularly useful in those applications which require the application of intense sonic energy, such as soldering, descaling of workpieces, emulsifying of two liquids, homogenizing a liquid mixture and the like.

Further and still other features of the present invention will be more clearly apparent by reference to the following description when taken in conjunction with the accompanying drawings.

Brief Description of the Drawings

FIG. 5 is a plan view of a certain embodiment of the invention;

FIG. 6 is a plan view of a modified arrangement per FIG. 5;

FIG. 7 is a further modified embodiment of the arrangement shown in FIG. 5;

FIG. 8 illustrates an alternative method of coupling the wave guide to the source of sonic energy;

FIG. 9 is a perspective view showing a still further embodiment, and

FIG. 10 is a schematic elevational view of a specific arrangement involving an irregularly shaped workpiece.

Detailed Description of the Invention

Figure 1:
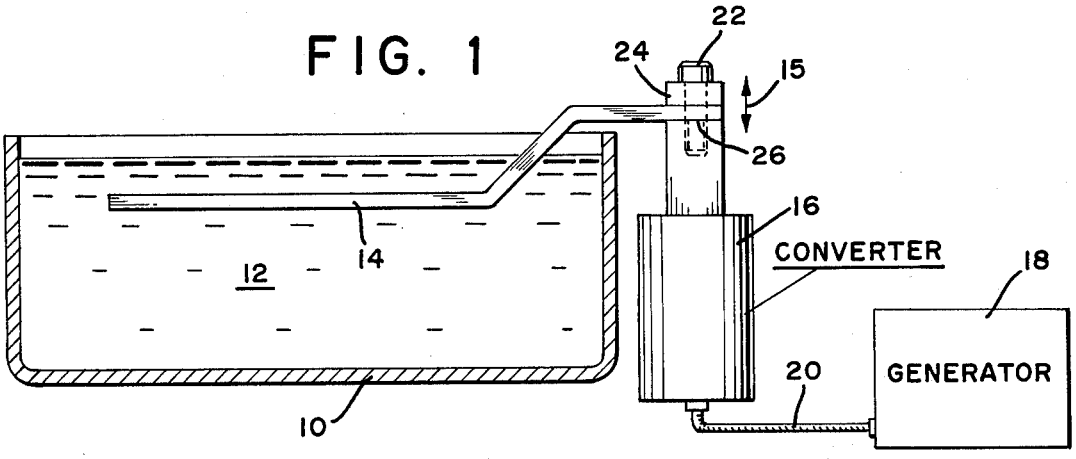
FIG. 1 is an elevational view showing schematically an embodiment of the present invention.

Referring now to the Figures and FIG. 1 in particular there is shown a container 10 which is filled with a liquid 12, such as water, molten metal and the like. A wave guide 14 in the form of a metal strip is immersed with one end in the liquid 12 and with its other end is coupled to a converter unit 16 which provides high frequency vibrations, preferably in the sonic and ultrasonic frequency range from 1 to 100 kHz, by being energized from a high frequency electrical generator 18 via a cable 20. The converter unit, in a typical example, is of the construction shown in U.S. Pat. No. 3,328,610, issued to S. E. Jacke et al., dated June 27, 1967, entitled "Sonic Wave Generator". The converter unit 16 provides vibrations along its longitudinal axis and is dimensioned to operate as a half wavelength resonator at a predetermined frequency of sound, for instance 20 kHz. The wave guide 14 is coupled to the converter by having one end thereof clamped to the converter at an antinodal region thereof, the antinodal region being defined as the area where there is maximum motional excursion along the longitudinal axis as is indicated by the double headed arrow 15.

Figure 2:
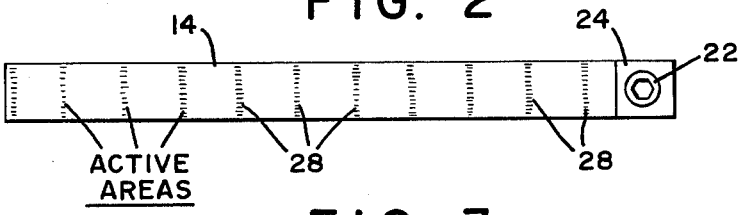
FIG. 2 is a plan view of a typical wave guide shown in FIG. 1.

As more clearly seen in FIG. 2, clamping is achieved by tightening a screw 22 so that a bushing 24 urges the underside of the wave guide 14 into intimate contact with the radial end surface 26 of the converter, such end surface being disposed substantially at the antinodal region of longitudinal motion as stated above.

Figure 3:
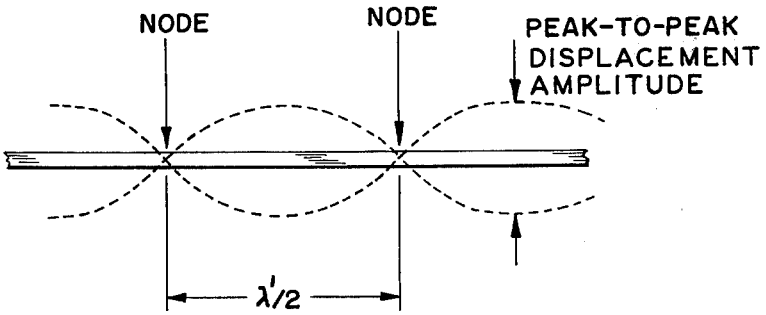
FIG. 3 is a schematic illustration explaining certain phenomena.
Figure 4:
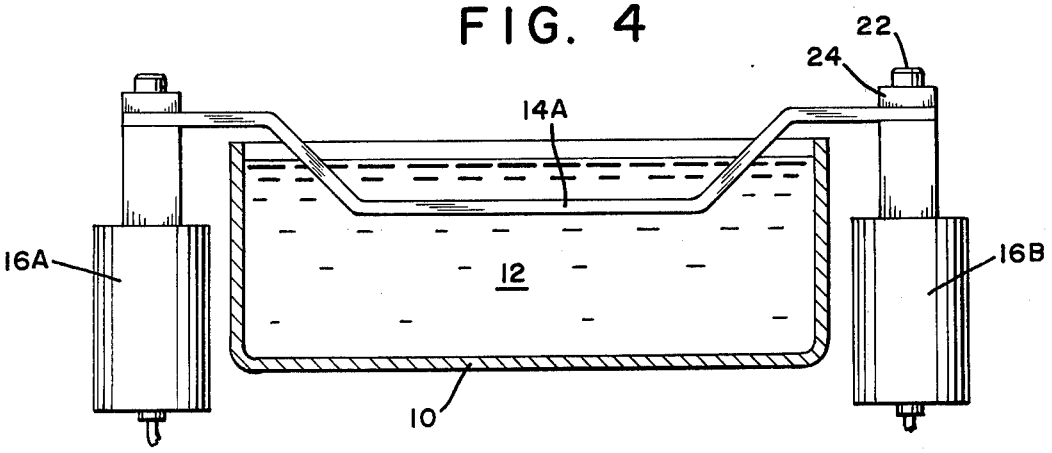
FIG. 4 is a schematic illustration of an alternative embodiment.

The wave guide 14, typically a flat metal strip of rectangular cross sectional area, receives the vibratory energy and propagates it in the form of flexural waves, see Fredrick and Hueter et al., supra. Using, for instance, a frequency of 20 kHz and a stainless steel strip one inch (26 mm) wide and a ¼ inch (6.5 mm) thick, active areas, that is, antinodal regions as shown by the shading in FIG. 2, are distanced from one another 0.6 inch (15 mm) apart. Conversely, nodal points are spaced apart by the same distance, which distance corresponds to $\lambda'/2$ as seen in FIG. 3. The peak displacement amplitude of the standing waves can be increased relative to the displacement amplitude of the energy source 16, arrow 15, by varying the length of the wave guide. FIG. 4 shows an alternative arrangement wherein the wave guide 14A has a central section which is immersed in the liquid 12 and wherein both ends are disposed outside of the liquid and each such end being coupled to a converter 16A and 16B respectively. In order to make the peak amplitude displacement of the wave guide equal to the peak amplitude displacement of the converter at the antinodal region, the length of the wave guide between the clamped terminations is selected to be $n\ \lambda'/2$, wherein $n$ is a positive integer and $\lambda'$ is the wavelength of the flexural waves propagated along the strip.

It has been noted that in the active areas 28 excellent transfer of vibratory energy to the liquid occurs which, in the case of water causes cavitation of the liquid. Such action is useful for cleaning, degreasing, emulsification, cell disruption and such other processes in which high intensity vibratory energy is desired.

For providing electrical circuit connections between the conductors of components which are mounted upon an electrical printed circuit board and the conductive areas of the board, it is frequently required that such bonding occur in a fluxless manner. Ultrasonic vibrations which agitate the solder bath accomplish the removal of oxide and effect the desired solder bond. Moreover, in cases where flux is used, ultrasonics reduces the reject rate of soldered assemblies. FIGS. 5, 6 and 7 clearly illustrate how this can be accomplished by means of the present invention. Numeral 40 identifies a printed circuit board which is "floated" over the surface of a molten solder bath and moved in the direction of the arrow 42. A wave guide 14, as shown in FIG. 1, is immersed slightly below the surface of the molten liquid. The vibrations at the antinodal regions of the wave guide vibrate the solder and a high quality solder joint is obtained. To overcome non-uniformity of ultrasonic exposure which may result due to the presence of active and dead areas along the wave guide, the wave guide 14 can be arranged to be angled relative to the translating motion of the board, arrow 42, so that in the course of the translatory motion, each area of the board comes into contact with the sonically activated molten solder, see FIG. 6. A still further alternative embodiment is shown in FIG. 7 wherein two wave guides 14 and 14B are arranged in side by side relation, but the wave guides are slightly staggered to cause the antinodal region of one wave guide to be juxtaposed with the nodal region of the second wave guide. Thus, there is a shift between wave patterns of the two strips equal to $\lambda'/4$. The two wave guides can be energized also from a single converter.

A further way of coupling a wave guide 14 is shown in FIG. 8 wherein the converter 16 is fitted with a half wavelength horn 46, also known as tool, resonator, mechanical amplitude transformer and the like. The wave guide 14 is rigidly clamped with its end between the converter end surface and one end surface of the horn 46. As stated before, the coupling of the wave guide to the source of sonic energy is accomplished at the antinodal region of the source of sonic energy.

FIG. 9 illustrates a further modification wherein a relatively wide wave guide 14C is coupled to a converter 16 by means of a slotted bar horn 48 which, as is well-known in the art, is dimensioned to resonate as a half wavelength resonator at the predetermined frequency. The wave guide 14C is coupled to the output surface of the horn 48 by means of a cover plate 50 and a plurality of screws 52 which provide clamped contact between the wave guide and the horn.

It will be apparent that the present wave guide arrangement is eminently suited for achieving agitation by sonic energy of an ultrasonic bath for the purpose of degreasing, cleaning, etching, and the like. However, the present wave guide arrangemennt has one particular noteworthy advantage which resides in the feature that the strip can be bent to conform to the shape of an irregularly shaped workpiece and thereby enhance the cleaning or degreasing action by providing high intensity sonic energy very close to the workpiece surface. This is shown more clearly in FIG. 10 wherein a workpiece W is suspended by a lifting rod 60 in the liquid 12. The free end of the wave guide 14D is bent to conform to the surface of the workpiece. The cavitation in the liquid resulting from the sonic energy provided to the wave guide occurs in close proximity to the workpiece surface.

It will be apparent that the heretofore described arrangements are extremely simple and easy to operate. Specifically, the wave guides can be prepared and manufactured in various shapes and forms, are readily replaceable, are inexpensive, and do not form a portion of the container or tank structure. Hence, if a particular wave guide is corroded, or erodes by cavitation during use, it can readily be replaced without significant cost. Moreover, the converter 16 is not a permanent part of the container, thereby permitting ease of maintenance, exchange or the use of different converters with various power ratings depending upon the particular work to be accomplished. Moreover, a standard liquid bath can readily be converted to one having sonic energy agitation.

While there have been described and illustrated certain preferred embodiments of the present invention, it will be apparent to those skilled in the art that further variations and modifications may be made without deviating from the scope of the invention which shall be limited only by the scope of the appended claims.

What is claimed is:

1. A sonic apparatus comprising:

a liquid;

a wave guide dimensioned to undergo flexural vibrations disposed in said liquid, and means coupled to said wave guide for transmitting sonic energy to said wave guide for causing responsive to the propagation of flexural waves said wave guide to undergo flexural vibrations for producing vibrations in said liquid.

2. A sonic apparatus comprising:

a liquid;

a wave guide dimensioned to undergo flexural vibrations disposed in said liquid and having at least one end outside said liquid, and means coupled to said one end for transmitting sonic energy to said wave guide for causing responsive to the propagation of flexural waves said wave guide to undergo flexural vibrations for producing vibrations in said liquid.

3. A sonic apparatus as set forth in claim 2, said wave guide being a strip of metal.

4. A sonic apparatus as set forth in claim 3, said means coupled to said one end comprising a source of sonic energy dimensioned to resonate as a half wavelength resonator at a predetermined frequency of sound traveling longitudinally through said source and exhibiting when resonant at least a pair of antinodal regions of longitudinal motion, and means coupling said strip of metal to said source of energy at one of said antinodal regions.

5. A sonic apparatus as set forth in claim 2, said wave guide having a substantially rectangular cross section.

6. A sonic apparatus as set forth in claim 2, said liquid being an aqueous solution.

7. A sonic apparatus as set forth in claim 2, said liquid being molten metal.

8. A sonic apparatus as set forth in claim 2, said wave guide having a bend.

9. A sonic apparatus as set forth in claim 2, said wave guide being a strip of metal having its two ends disposed outside said liquid, and means coupled to each of said ends for transmitting sonic energy to said wave guide.

10. A sonic apparatus comprising:

a liquid bath;

a source of energy dimensioned to resonate as a half wavelength resonator at a predetermined frequency of sound traveling longitudinally through said source and exhibiting when resonant at least two antinodal regions of longitudinal motion;

a wave guide comprising a strip of metal of substantially rectangular cross sectional area having at least one end outside said bath and a portion immersed in said bath, and means removably coupling said one end of said wave guide to said source at a surface disposed substantially in a plane through one of said antinodal regions for causing said wave guide responsive to the receipt of energy from said source to undergo flexural vibrations which are transmitted into said liquid, said vibrations being the result of the propagation of flexural waves in said guide.

11. A sonic apparatus as set forth in claim 10, said wave guide being with one of its sides forming said rectangular cross section in forced contact with said surface disposed substantially in a plane through one of said antinodal regions.

12. The method for subjecting a liquid to high frequency sonic energy comprising:

providing a liquid;

immersing a wave guide in said liquid, and causing flexural waves to be propagated along said wave guide for causing said wave guide to undergo flexural vibrations and exhibiting a pattern of standing waves.

13. The method for subjecting a liquid to high frequency sonic energy as set forth in claim 12, said wave guide comprising a metal strip.

14. The method for subjecting a liquid to high frequency sonic energy as set forth in claim 13, said metal strip having a rectangular cross sectional area.

15. The method for subjecting a liquid to high frequency sonic energy comprising:

providing a liquid;

immersing one portion of a wave guide in said liquid while disposing another portion of said wave guide outside said liquid;

coupling said another portion to a source of high frequency sonic energy for causing said wave guide responsive to said source being operative to undergo flexural vibration for exhibiting a pattern of standing waves, which waves cause vibrations in the liquid and said vibrations being the result of the propagation of flexural waves in said guide.

16. The method for subjecting a liquid to high frequency sonic energy as set forth in claim 15, said source being a half wavelength resonator providing at a predetermined frequency vibrations along a longitudinal axis and exhibiting when resonant at least one nodal region and a pair of antinodal regions of longitudinal motion, and said wave guide being coupled to one of said antinodal regions.

* * * * *